United States Patent [19]

Kaschak

[11] 4,010,623

[45] Mar. 8, 1977

[54] REFRIGERANT TRANSFER SYSTEM

[76] Inventor: Anthony A. Kaschak, Rte. 5, Box 128-C, Scottsboro, Ala. 35768

[22] Filed: Apr. 12, 1976

[21] Appl. No.: 676,319

[52] U.S. Cl. ..... 62/55; 62/60; 141/5; 141/82

[51] Int. Cl.[2] ..... F17C 7/02

[58] Field of Search ..... 141/82, 5; 222/146 C; 62/55, 60

[56] References Cited

UNITED STATES PATENTS

| | | | |
|---|---|---|---|
| 3,241,328 | 3/1966 | Engel et al. | 62/55 X |
| 3,272,238 | 9/1966 | Groppe | 62/55 X |
| 3,282,305 | 11/1966 | Antolak | 141/5 |
| 3,946,572 | 3/1976 | Bragg | 62/55 X |

*Primary Examiner*—Ronald C. Capossela
*Attorney, Agent, or Firm*—C. A. Phillips

[57] ABSTRACT

A system for filling small refrigerant containers from a larger container in which the refrigerant is passed downward through a cylinder which is cooled by a refrigeration coil placed in the cylinder, the coil effecting a lower temperature at the bottom of the cylinder than at the top of the cylinder.

3 Claims, 1 Drawing Figure

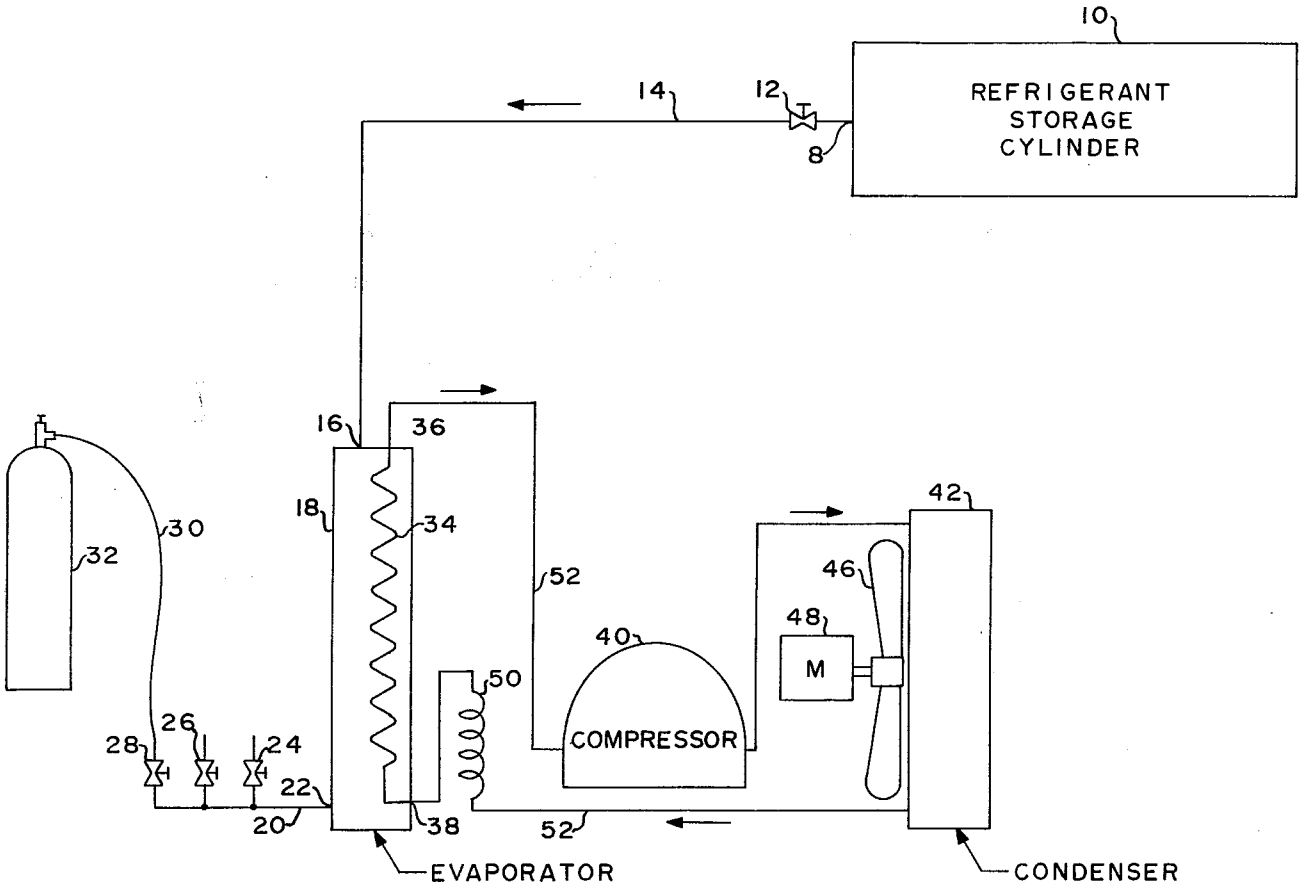
REFRIGERANT STORAGE CYLINDER
10
8
12
14
CONDENSER
42
46
48
M
COMPRESSOR
40
52
52
50
36
34
38
EVAPORATOR
16
18
22
20
24
26
28
30
32

REFRIGERANT TRANSFER SYSTEM

BACKGROUND OF THE INVENTION

1. Field of the Invention

This invention relates to refrigeration service equipment in transferring refrigerant from one closed system to another closed system, and particularly to a system for filling smaller refrigerant containers from a large container.

2. General Description of the Prior Art

Refrigeration and air-conditioning service personnel employ relatively small tanks of refrigerant in liquid form, typically holding 5 to 150 pounds, being a size that is readily transportable to and between jobs. The amount of refrigerant in such tanks is fairly rapidly used up, requiring that the tanks be filled fairly frequently. They are then refilled from a larger container of liquid refrigerant, and the problem is in effecting transfer, particularly to do so in a safe manner. The common refrigerants used are Freon 12, 22, and 502, these having a progressive boiling point, with Freon 12 boiling at −21.6° F. at 0 PSI, and Freon 502 boiling at −49.5° F. at 0 PSI. These characteristics are typically utilized in the transfer of refrigerant by heating the larger supply container to a temperature higher than the smaller container to create a higher pressure in the larger container than in the smaller one. The problem is that a little too much heat will cause excessive pressure and is likely to cause an explosion, and such has occurred many times and a good many people have been killed. Alternately, transfer may be effected by lowering the temperature of the smaller container below that of the larger container, but this is a quite lengthy process and thus not efficient.

SUMMARY OF THE INVENTION

Accordingly, it is the object of this invention to provide a safe system for effecting the transfer of refrigerant, and one which does not involve the application of heat and thereby the creation of increased pressures. Instead, in accordance with the present invention, an intermediate tank or cylinder is employed between the storage container and the container being filled through which the refrigerant is caused to flow. Flow is provoked by placing the inlet of the intermediate tank at one end and the outlet at the opposite, or second, end and placing an evaporation coil of a refrigeration system in the tank, with the cooler end of the coil at the second end of the container and the warmer end at the first end of the tank. In this fashion, a temperature gradient is achieved with a higher temperature at the first end than at the second end, thus effecting a high characteristic pressure gradient with a higher pressure at the first end than at the second end, and this in turn induces the transfer between containers.

BRIEF DESCRIPTION OF THE DRAWING

The single drawing is a schematic illustration of an embodiment of the invention.

DETAILED DESCRIPTION OF THE PREFERRED EMBODIMENT

Storage tank 10 contains refrigerant in liquid form, typically holding 100 pounds or more of refrigerant. An outlet 8 of tank 10 is connected through valve 12 and line 14 to an inlet 16 at the top of an elongated container 18. Container 18 is oriented, as shown, with its length dimension vertical and has a relatively small cross section (typically 0.75 to 7.06 square inches in cross section, and an example being a circular cross section having a diameter of 1.57 inches) compared with its length, typically 11 to 36 inches. Outlet line 20 connects from outlet 22 at the bottom of container 18 to a plurality of hand-operated valves 24, 26, and 28, valve 28 shown as being connected through line 30 to small tank 32. Tank 32, typically referred to as a service tank or service cylinder, would have, for example, a capacity of 5 to 150 pounds of liquid refrigerant. A coil 34, typically constructed of 0.375-inch O.D. (outer diameter copper tubing, is placed inside container 18 and extends between its upper and lower ends, the coil passing through the walls of tank 18 by sealed connections at points 36 and 38. Coil 34 is then connected in a refrigeration loop where it functions as an evaporation coil. Thus, it is connected in circuit with compressor 40, condenser 42 (condensing fan 46 and fan motor 48 are used with the condenser), and a capillary tube or other restrictive orifice 50, the latter being connected to the bottom end of coil 34. The direction of refrigerant flow in connecting line 52 is shown by the arrows. In operation, evaporation in coil 34 commences and is maximum at its lower, or bottom, end. This configuration provokes a temperature gradient within tank 18 with a maximum cooling at the bottom of the tank. The sizing of components of this refrigeration loop is such to provoke at least a 10° temperature difference between the upper and lower ends of container 18 during a transfer operation. Thus, for example, a capacity of the refrigeration loop would be in the range of ⅛ to ¾ tons, with tank 18 sizes as described above.

To fill tank 32 from tank 10, valve 28 is opened, and the refrigeration system is turned on. As refrigerant flows downward through the top of container 18, it is cooled to a temperature below ambient, and thus below the temperature surrounding storage tank 10. As a result, the pressure of vapor given off by the refrigerant is lower in container 18 than in tank 10, and lower at the bottom of container 18 than at the top of container 18. This difference in pressure promotes flow from tank 10 to tank 32 both safely and rapidly. For example, with an ambient temperature of 72°,it has been found that a tank with the capacity of 25 pounds can be filled within three minutes.

Having thus described my invention, what is claimed is:

1. In a system for transferring refrigerant from a large storage container to a smaller service container, the combination comprising:

an elongated cylinder;

first coupling means for coupling a large, storage, refrigerant container to the interior of said cylinder at a first end of said cylinder;

second coupling means for coupling a smaller, service, container to the interior of said cylinder at the opposite end of said cylinder;

an evaporation coil positioned within said cylinder and having a first end exiting at said first end of said cylinder, and having a second end exiting at said opposite end of said cylinder; and a compressor, condenser, and flow restriction means connected in series in the named order between said first end of said coil and said second end of said coil, said flow restriction means being positioned adjacent said second end of said coil, whereby a refrigerant loop is defined by said compressor, said condenser, said flow restriction means, and said coil, and a second refrigerant placed in said loop is evaporated in said coil, creating a temperature gradient in said cylinder which is cooler at said opposite end than at said first end of said cylinder, whereby a pressure gradient is created in said cylinder around said coil in which said pressure is greater at the first end of said cylinder than at the opposite end, causing refrigerant from the large storage container to flow into the smaller service container.

2. A system as set forth in claim 1 wherein said cylinder has an inner cross sectional area of 0.75 to 7.06 square inches, and the length of said cylinder is 11 to 36 inches.

3. A system as set forth in claim 2 wherein said compressor, said condenser, said flow restriction means, and said coil are sized to provide a cooling capacity of ⅛ to ¾ tons.

* * * * *